US006053658A

United States Patent [19]

Gibson, Jr.

[11] Patent Number: 6,053,658

[45] **Date of Patent: *Apr. 25, 2000**

[54] APPARATUS AND METHOD FOR ROADWAY INFORMATION DISPLAY

[76] Inventor: Henry C. Gibson, Jr., P.O. Box 1208, Atlanta, Tex. 75551

[ * ] Notice: This patent issued on a continued prosecution application filed under 37 CFR 1.53(d), and is subject to the twenty year patent term provisions of 35 U.S.C. 154(a)(2).

[21] Appl. No.: 09/008,206

[22] Filed: Jan. 16, 1998

[51] Int. Cl.[7] ..... E01F 9/016; E01F 9/017

[52] U.S. Cl. ..... 404/10; 116/63 P; 40/612

[58] Field of Search ..... 404/6, 9, 10; 116/63 R, 116/63 P, 63 C; 40/608, 612

[56] References Cited

U.S. PATENT DOCUMENTS

| | | | |
|---|---|---|---|
| 1,755,443 | 4/1930 | Hartzler et al. . | |
| 4,645,168 | 2/1987 | Beard | 248/548 |
| 5,252,893 | 10/1993 | Chacham et al. | 315/200 A |
| 5,267,523 | 12/1993 | Hugron | 116/63 R |
| 5,484,225 | 1/1996 | Warner . | |
| 5,487,619 | 1/1996 | Winebrenner . | |
| 5,633,565 | 5/1997 | Friedman et al. | 315/200 A |
| 5,713,694 | 2/1998 | Monda et al. | 404/9 |
| 5,788,405 | 8/1998 | Beard | 404/10 |

FOREIGN PATENT DOCUMENTS

| | | | |
|---|---|---|---|
| 3843245 | 6/1990 | Germany | 404/9 |
| WO9662322 | 8/1996 | WIPO | E01F 9/017 |

*Primary Examiner*—James A. Lisehora
*Attorney, Agent, or Firm*—John F. Bryan

[57] ABSTRACT

Disclosed is an improved roadway information display apparatus wherein scrap tire particles are molded to form a support base and opposed lengths of elastomeric material of corded ply construction are fastened to the support base so as to provide a flexibly hinged connection for a vertically extending information display board. For improved visibility, the display board may be highlighted by photo-cell operated LEDs, powered by a solar panel charged battery pack.

11 Claims, 4 Drawing Sheets

APPARATUS AND METHOD FOR ROADWAY INFORMATION DISPLAY

TECHNICAL FIELD

The present invention relates generally to the field of road signs and more particularly, to temporary portable displays usable for hazard warning and traffic control.

BACKGROUND OF THE INVENTIONS

Unusual road conditions such as lane closures or detours for construction work require that traffic warning and control measures be put in place, usually the posting of appropriate warnings and speed limits. Barricades are commonly used to demark a closed traffic lane or road hazard. While a sign may be posted at the barricade, good traffic safety practice requires that a warning notice, and usually a reduced speed limit, should be posted alongside the roadway, well ahead of the hazard. This information should be in a highly visible display and conspicuously placed, closer to the path of traffic than the norm for permanently installed roadside signs.

Road construction projects are a good example of situations that require temporary warning signs. The ubiquitous orange traffic cones help greatly in marking lane changes and hazard boundarys, even supplanting barricades to some extent. Traffic cones are light weight, easy to handle and inexpensive. Moreover, they are resilient so as to tolerate traffic abuse, and cars or trucks can contact them without risking significant damage. Since they cannot convey information except by their presence, traffic cones are an imperfect warning system at best. Presently available temporary signs are much the same as their permanently installed siblings, except for being mounted on a hard portable base, with or without wheels, or a weighted stand. Thus, there continues to be a need for a high visibility information display suitable for temporary installation, close to the path of traffic.

Therefore, a first object of the present invention is to provide apparatus for display of roadway information, such as warnings, speed limits and the like, in a form that is highly visible and capable of being placed close to the path of traffic. A second object is that such apparatus be in a form that does not pose an additional hazard by its very proximity to the path of traffic. A third object is to provide such apparatus in a form that is resilient, so as to be tolerant of traffic abuse. A fourth object is that such display apparatus be in a form that is relatively light in weight and easy to handle and another object is that this apparatus provide an avenue for the recycling of srcap tires and conveyor belting, items that presently have few useful applications and pose a problem for waste disposal operations.

SUMMARY OF THE INVENTIONS

The present inventions contemplate providing improved apparatus for displaying roadway information wherein a molded resilient base, formed of a crumb rubber mixture, is connected to flat, opposed flexible members, supporting a display board on both sides so as to hold it in an erect position but allow it to deflect under impact. The display board preferably includes transistor illumination apparatus, powered by a solar panel charged power module mounted in a cavity in the molded base. The opposed flexible members are preferably made from corded ply elastomeric materials such as scrap tires or conveyor belting. The supporting base can be made by either a hot or cold bonding process, preferably from a mixture of finely divided scrap tire fragments and a bonding agent. If so desired, a density increasing additive such as crushed magnetite may also be included in the formulation, so as to enhance the stability of the supporting base.

BRIEF DESCRIPTION OF THE DRAWINGS

The accompanying drawings are incorporated into and form a part of the specification to assist in explaining the present inventions. The drawings illustrate preferred and alternative examples of how the inventions can be made and used and are not to be construed as limiting the inventions to only those examples illustrated and described. The various advantages and features of the present inventions will be apparent from a consideration of the drawings in which.

DETAILED DESCRIPTION OF THE DRAWINGS

Figure 1:
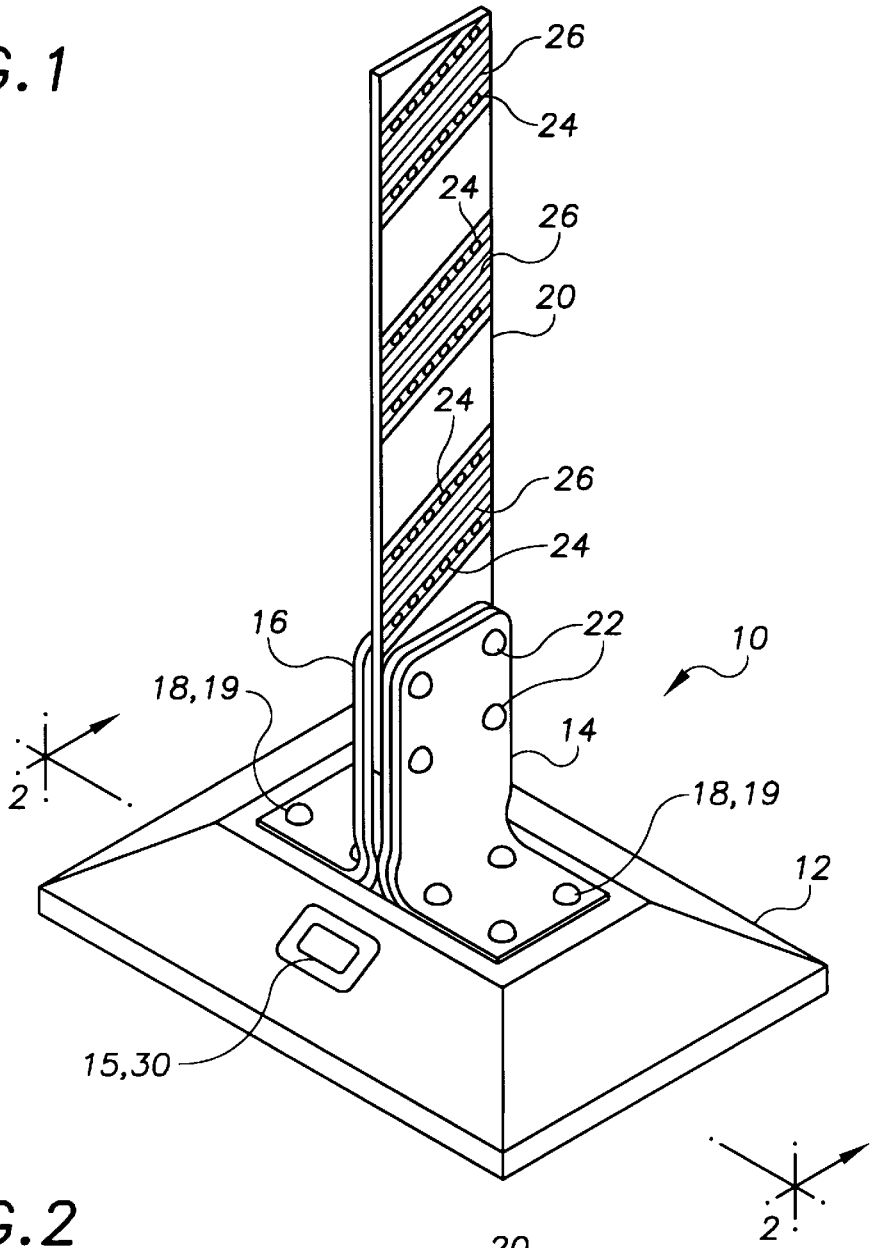
FIG. 1 is a perspective view of a preferred embodiment of the present inventions.

The present inventions are described in the following by referring to drawings of examples of how the inventions can be made and used. In these drawings, reference characters are used throughout the several views to indicate like or corresponding parts. In FIG. 1, there is seen a perspective view of one embodiment of an apparatus 10 for use in the display of roadway information is shown. The details of the apparatus 10 and alternative embodiments of the inventions are illustrated in FIGS. 2–8.

FIG. 1 shows support base 12 with first and second flexible display support members 14 and 16 connected thereto by carriage bolt 18 and nut 19. Support members 14 and 16 are shown as being cut from pieces of conveyor belting but may be also made from the tread portion of tire carcasses. Either way, textile or steel corded, ply construction elastomers can be salvaged from scrap that is otherwise difficult to recycle. Flexible support members 14 and 16 are fastened to the substantially horizontal upper surface of support base 12 by carriage bolts 18 and nuts 19, with the inner ends being bent about 90° to extend upward. Thus, display board 20 is tightly confined between the vertical portions of flexible support members 14 & 16, and held in place by fastener assemblies 22.

Display board 20 is of impact resistant construction and may be as shown, or may display stop, hazard warning, speed limit or other roadway information. In any case, one embodiment of the present inventions includes solar power module 30, mounted in cavity 15 in support base 12, where it is exposed to sunlight for recharging during daytime hours. Light emitting diodes (LEDs) 24 are powered by solar module 30 so as to accentuate the display information 26 after dark.

The low profile of support base 12 and the tough, flexible nature of support members 14 and 16 is such that display board 20 will deflect under impact, even to the point of bending flat, and spring back upright after impact.

Figure 2:
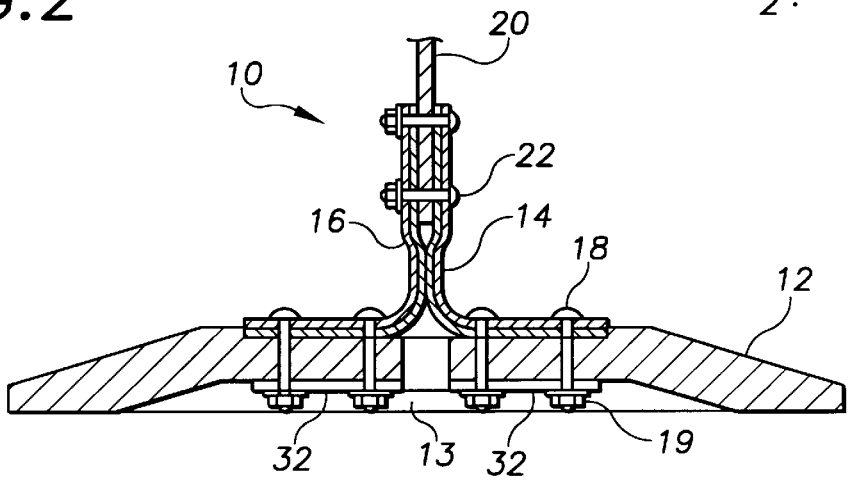
FIG. 2 is a vertical cross-section of the preferred embodiment as viewed along plane 2—2 of FIG. 1.

FIG. 2 shows a cross-section as viewed at the plane designated by arrows 2—2 of FIG. 1. Support base 12 is preferably formed from a mixture of finely divided scrap tire fragments and a bonding agent by either a hot or cold bonding process. There is no requirement to separate the fabric or steel cord material from the elastomer prior to the molding process. If so desired, a density increasing agent such as crushed magnetite may also be included in the formulation, so as to enhance the stability of support base 12. A recess 13 at the under surface of base 12 gives clearance for display attaching hardware as is described below, and assures stability by keeping the outer edges of base 12 in contact the ground so as to prevent "high center" rocking. Carriage bolts 18 are seen to extend through support members 14 and 16, through the thickness of support base 12. Nuts 19 are tightened to bear on bottom plates 32 and hold flexible support members 14 and 16 in solid assembly with support base 12. Thus, the combined stiffness of a plurality of flexible support members acts to support display board 20. Not only is there no need for bonding flexible support members 14 and 16 together where they are in contact, but the friction of relative motion between these parts has a beneficial damping effect.

Figure 3:
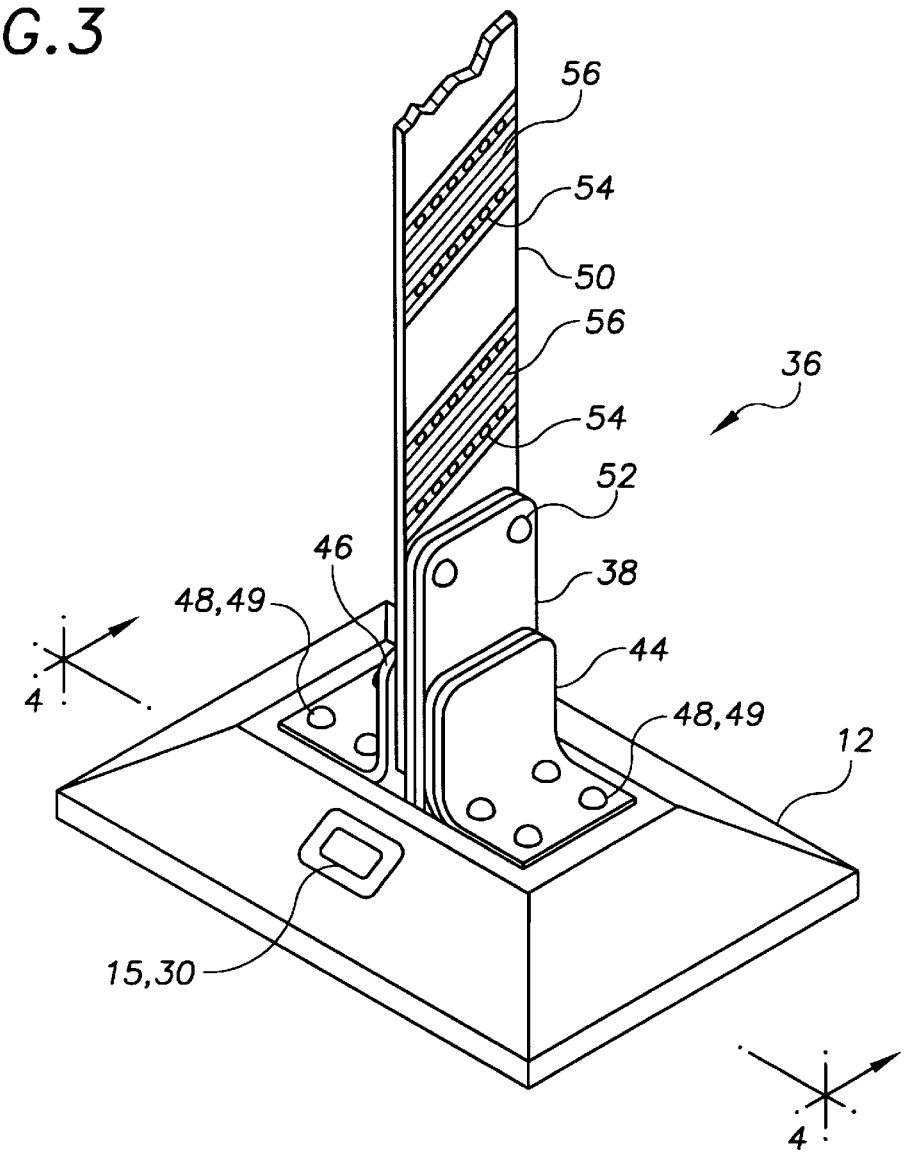
FIG. 3 is a perspective view of an alternative preferred embodiment of the present inventions.
Figure 4:
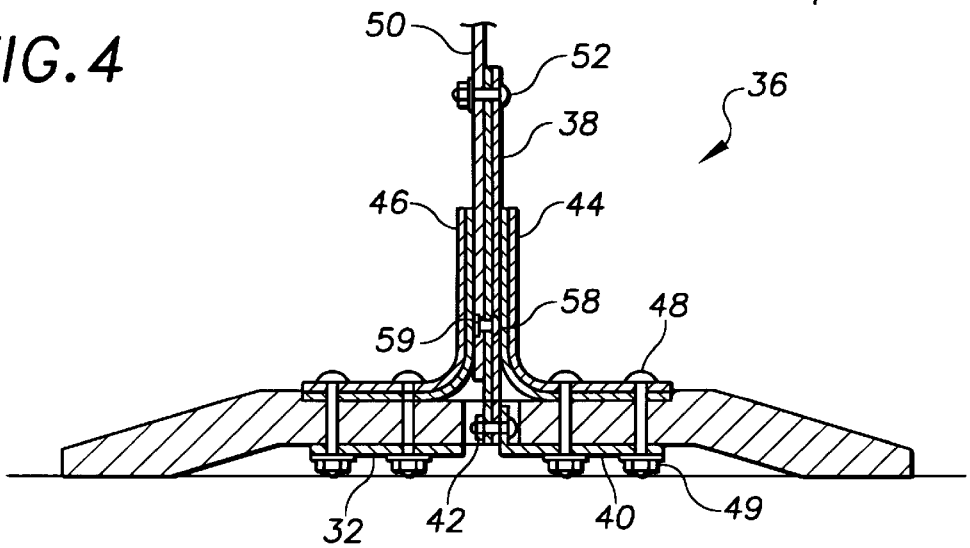
FIG. 4 is a vertical cross-section of the embodiment of FIG. 3 as viewed along plane 4—4 of FIG. 3.

FIGS. 3 and 4 show alternative display assembly 36, for use when the weight and/or sail area of the display board require greater supporting stiffness than provided by the embodiment of FIG. 1. Here, first and second flexible support members 44 and 46 are connected to base 12 by carriage bolts 48 and nuts 49. As in FIG. 1, support members 44 and 46 are cut conveyor belting or tire carcasses. flexible support members 44 and 46 are fastened to the substantially horizontal upper surface of support base 12 by carriage bolts 48, which pass through base 12 and bottom plates 32 and 40 where they are held by nuts 49. Adjacent end portions of flexible support members 44 and 46 are bent approximately 90° to extend upward. Display board 50 and an added flexible support member 38 are confined between the vertical portions of flexible support members 44 and 46. Bottom plate 40 has slotted bolt holes to facilitate assembly and is flanged upward for the attachment of added flexible support member 38 by fastener assemblies 42. Display board 50 is fastened to supporting member 38 by fastener assemblies 52 above support members 44 and 46 and by carriage bolts 58 and low profile nuts 59 within the area confined by support members 44 and 46. The low profile of nuts 59 and the rounded heads of carriage bolts 58 reduce interference with support members 44 and 46 so as to allow undisturbed flexing action. Thus, displacement of display board 50 from the normally vertical position is resisted by the stiffness of support member as buttressed by the added stiffness of support members 44 and 46.

Display board 50 is of impact resistant construction and may be as shown, or may display other roadway information. One embodiment of the present inventions includes solar power module 30, mounted in cavity 15 in support base 12 where it is exposed to light for recharging during daytime hours. As is described below in detail, light emitting diodes 54 are powered by solar module 30 to enhance display 56 after dark.

Figure 5:
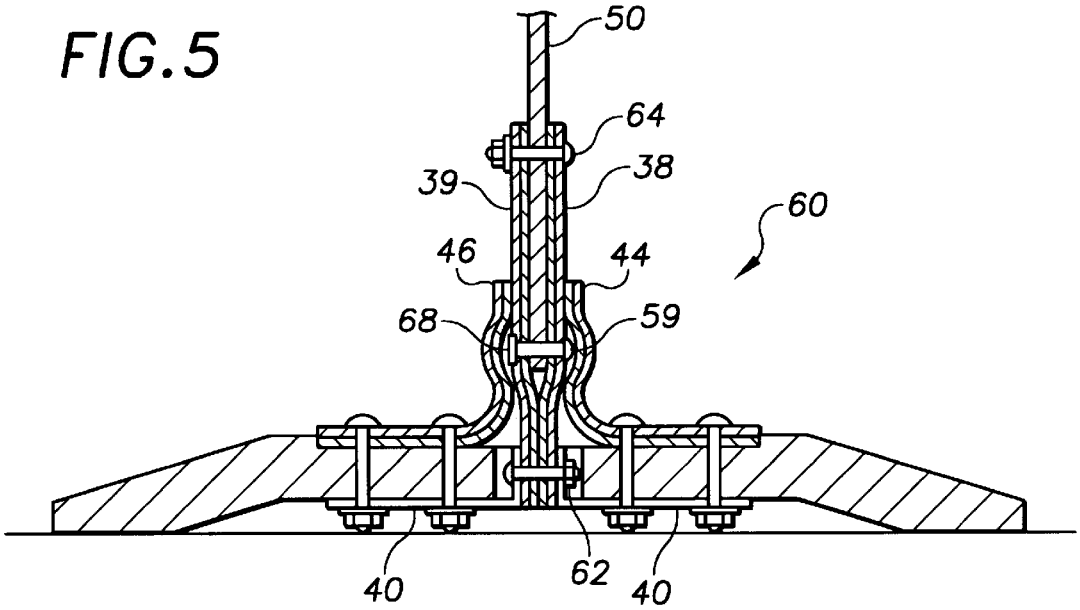
FIG. 5 is a vertical cross-section view of a second alternative preferred embodiment of the present inventions.

FIG. 5 shows a second alternative embodiment 60 of the present inventions, much the same as embodiment 36 of FIG. 3 except that yet another flexible support member 39 is provided, if required for added stiffness. Bottom plates 40 have slotted bolt holes to facilitate assembly and are flanged upward for the attachment of flexible support members 38 and 39 by fastener assemblies 62. Display board 50 is thus sandwiched between support members 38 and 39 and held in place by fastener assemblies 64 above support members 44 and 46 and by carriage bolts 68 and low profile nuts 59 within the area confined by support members 44 and 46. Thus, displacement of display board 50 from the normally vertical position is resisted by the stiffness of support members 38 and 39 as buttressed by the added stiffness of support members 44 and 46.

Figure 6:
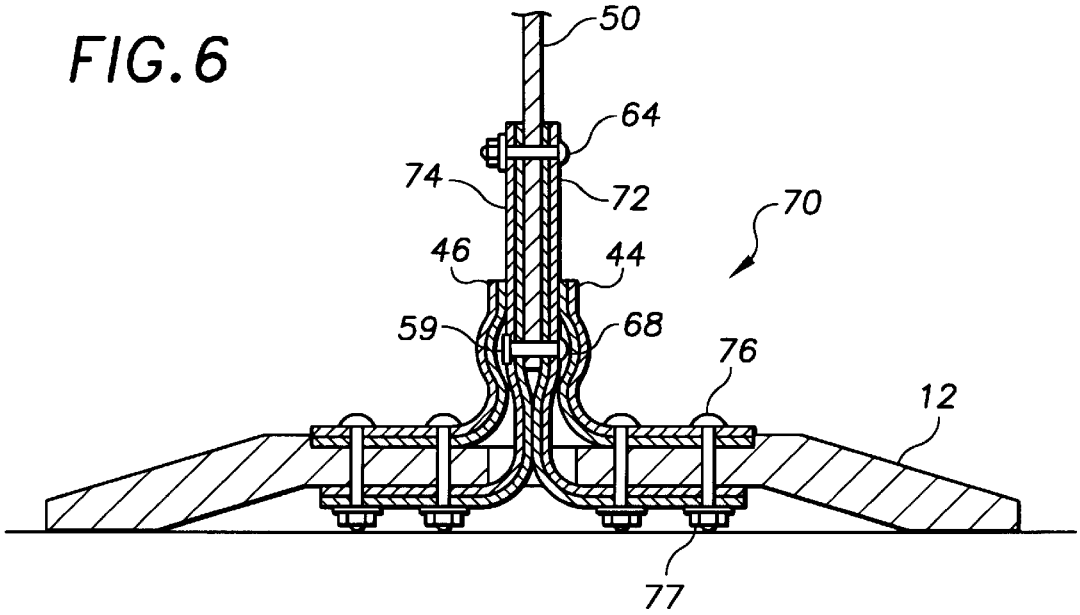
FIG. 6 is a vertical cross-section view of a third alternative preferred embodiment of the present inventions.

FIG. 6 shows a third alternative embodiment 70 of the present inventions, much the same as embodiment 60 of FIG. 5 except that added flexible support members 72 and 74 are bent 90°, in a manner similar to the bending of support members 44 and 46, so as to extend horizontally for attachment to the under surface of base 12. Carriage bolts 76 extend through support members 44 and 46 and through base 12 to pass through matching holes in support members 72 and 74. The assembly of support members 44, 46, 72 & 74 to base 12 is completed by threading on and tightening nuts 77. Display board 50 is thus sandwiched between support members 72 and 74 and held in place by fastener assemblies 64 above support members 44 and 46 and by carriage bolts 68 and low profile nuts 59 within the area confined by support members 44 and 46. Thus, displacement of display board 50 from the normally vertical position is resisted by the stiffness of support members 72 and 74 as buttressed by the added stiffness of support members 44 and 46.

Figure 7:
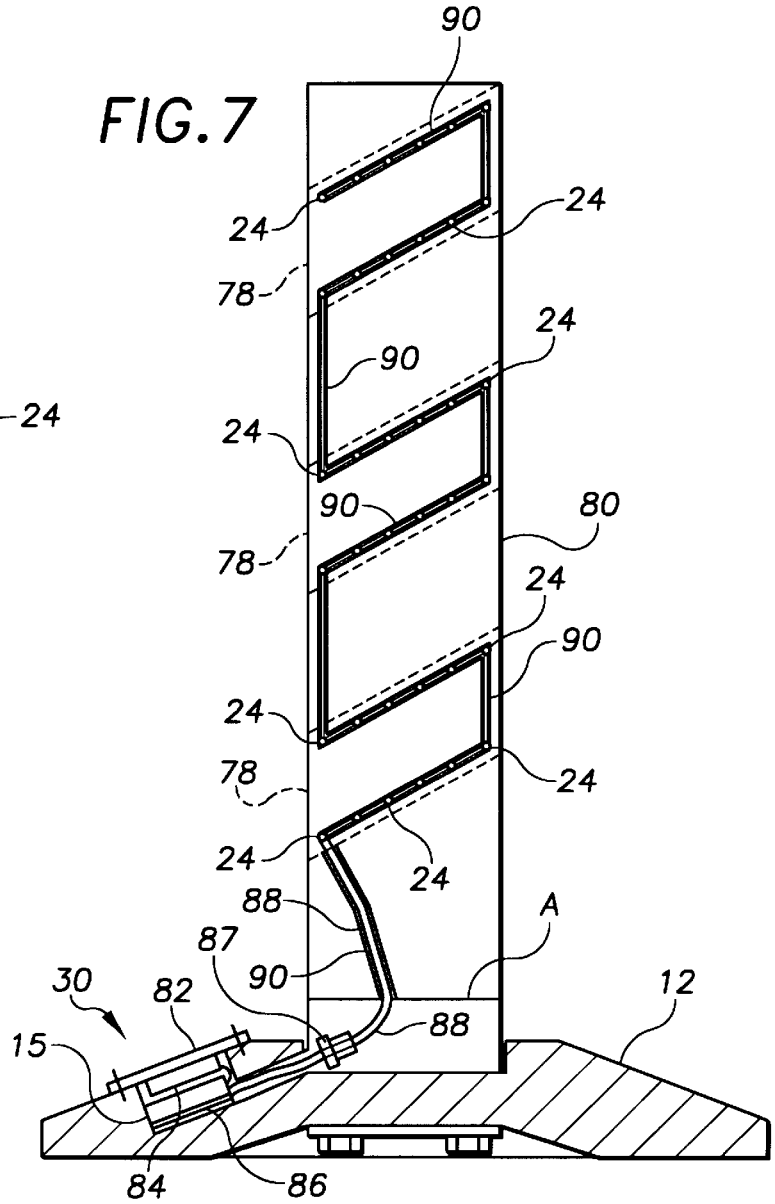
FIG. 7 is a view of an embodiment of the inventions, showing the mounting of lights to accentuate display information.

FIG. 7 shows a transverse cross-section view of support base 12, taken through solar power module cavity 15. Here, solar power module 30 is seen to comprise transparent retaining cover 82, solar panel 84, and battery pack 86 with connector 87. Light emitting diodes 24, sufficient in number to adequately accentuate display information areas 78, are connected in parallel along the length of two conductor LED cable 88. Groove 90 is routed out in display board 80 so as to provide a path for LED cable 88. Holes spaced along groove 90 receive light emitting diodes 24, which penetrate to illuminate display information areas 78 on the far side of display board 80. Groove 90 is preferably filled with epoxy to provide a flush surface finish. If so desired, slightly offset but otherwise identical display areas may be prepared on the near side of display board 80 and illuminated from the far side in a similar manner.

Figure 8:
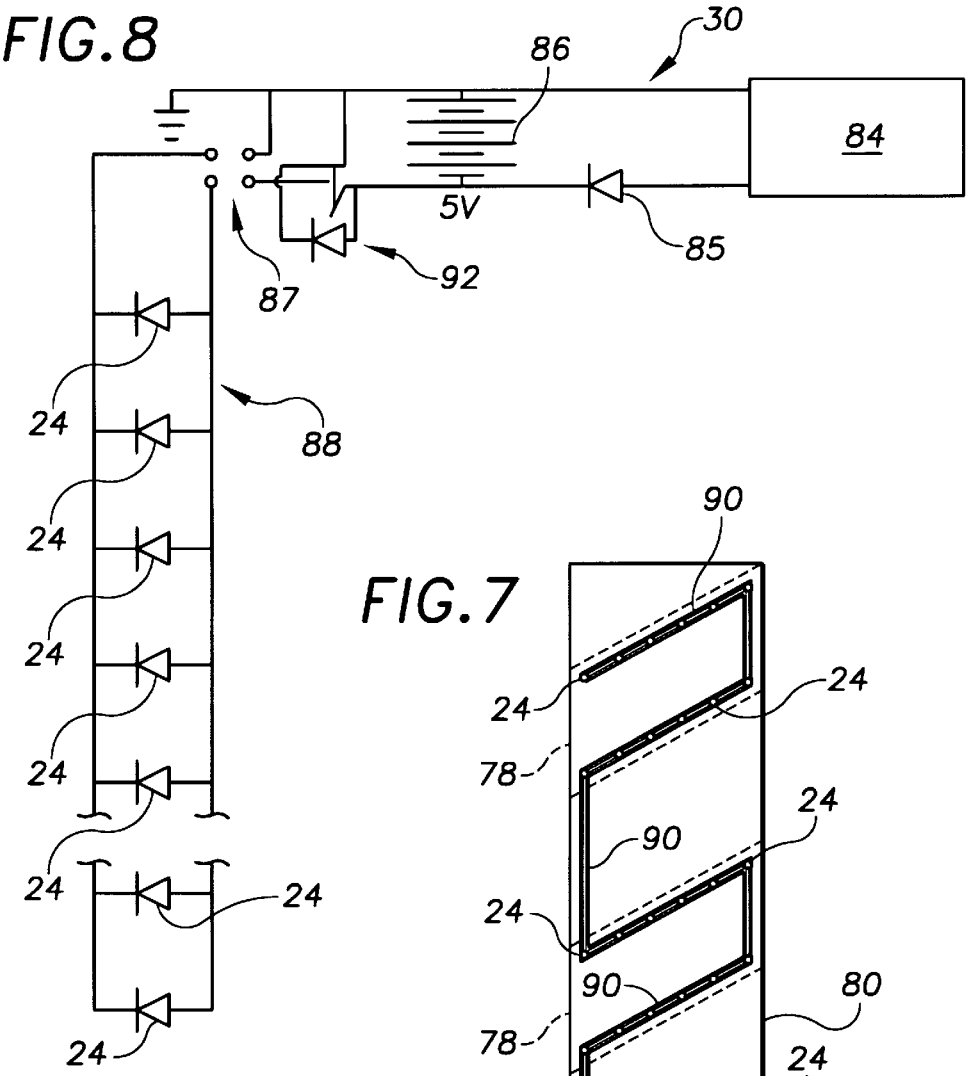
FIG. 8 is an electrical schematic of the lighting system of the embodiment of the present inventions as shown in FIG. 7.

FIG. 8 is a schematic diagram of solar power module 30 and LED cable assembly 88. Here is shown solar panel 84, connected to battery pack 86 through diode 85, and photo-switch 92. If so desired, a flasher circuit can also be included, both to attract attention and extend operating time for a given battery charge level. In the absence of significant light intensity, photo-switch 92 closes so as to connect the 5 volt battery supply through connector 87 to LED cable assembly 88. A plurality of light emitting diodes 24 are connected in parallel along the length of LED cable assembly 88, spaced to conform to the hole spacing required for physical installation.

The embodiments shown and described above are exemplary. It is not claimed that all of the details, parts, elements, or steps described and shown were invented herein. Even though numerous characteristics and advantages of the present inventions have been described in the drawings and accompanying text, the description is illustrative only, and changes may be made in the detail, especially in matters of shape, size, and arrangement of the parts within the principles of the inventions to the full extent indicated by the broad general meaning of the terms used in the attached claims.

The restrictive description and drawings of the specific examples above do not point out what an infringement of this patent would be, but are to provide at least one explanation of how to use and make the inventions. The limits of the inventions and the bounds of the patent protection are measured by and defined in the following claims:

I claim:

1. In apparatus for the display of roadway information of the type having a horizontally extensive support base, a display board and a flexible mounting securing the display board to the support base for bending in response to forces acting on the display board, the improvement comprising:

two elongated, multiple ply construction elastomeric members, with parallel inner and outer faces, each member having a first portion including a first end and a second portion including a second end;

fasteners attaching the first portions of the elongated members to the support base at opposed locations, so that the inner faces of the second portions are opposed and bend approximately ninety degrees upwards to extend vertically above the support base;

a display board extending vertically above the support base and having upper and lower ends, with the lower end being held between the inner faces of the second portions and otherwise unrestrained with respect to the support base; and fastening means attaching the elongated members to the display board.

2. Apparatus for the display of roadway information according to claim 1 wherein:

said inner faces of the second portions contact throughout a discrete area; and the lower end of said display board is held between the inner faces of the second portions above the discrete area of contact.

3. Apparatus for the display of roadway information according to claim 1 wherein the fastening means comprises:

a plurality of vertically spaced apart fasteners attaching the elongated members to the display board proximate the second ends.

4. Apparatus for the display of roadway information according to claim 1 wherein:

said inner faces of the second portions are in contact throughout a discrete area;

said display board is held between the inner faces of the second portions, above the area of contact; and said fastening means comprises a plurality of vertically spaced apart fasteners attaching the elongated members to the display board proximate the second ends.

5. Apparatus for the display of roadway information according to claim 1 wherein said two elongated, multiple ply construction elastomeric members each comprise a single thickness of conveyor belting.

6. Apparatus for the display of roadway information according to claim 1 wherein said two elongated, multiple ply construction elastomeric members each comprise two thicknesses of conveyor belting.

7. Apparatus for the display of roadway information according to claim 6 wherein:

said inner faces of the second portions contact throughout a discrete area; and the lower end of said display board is held between the inner faces of the second portions, above the discrete area of contact.

8. A method for displaying roadway information with a display of the type having a display board mounted on a support base comprising the steps of:

providing a horizontally extensive support base having upper and under surfaces;

providing a substantially rigid display board having a lower end;

providing two elongated, multiple ply construction elastomeric members each having lower portions;

securing the two elongated elastomeric members to the support base at opposed locations, so that the elastomeric members contact each other and bend upwards to extend vertically above the support base;

inserting the display board between the vertically extending elastomeric members; and securing the display board to the elastomeric members so that the display board is mounted vertically therebetween while being otherwise unrestrained with respect to the support base and capable of deflection to the horizontal under impact.

9. The method of claim 8 and further comprising the steps of:

providing a centrally located hole connecting the upper and under surfaces of the supporting base member;

passing the lower portions of the two elongated, ply construction elastomeric members through the hole in the supporting base member so that the members are positioned to be secured to the under surface of the supporting base at the under surface thereof.

10. The method of claim 8 and further comprising the step of illuminating the information so displayed.

11. The method of claim 8 and further comprising the steps of:

allowing inner faces of the elastomeric members to be in mutual contact throughout a discrete area; and positioning the lower end of said display board between the inner faces of the elastomeric members above the discrete area of contact.

* * * * *